US007581321B2

(12) United States Patent
Kain

(10) Patent No.: US 7,581,321 B2
(45) Date of Patent: Sep. 1, 2009

(54) FOLDING KNIFE

(75) Inventor: Charles L. Kain, Indianapolis, IN (US)

(73) Assignee: GB II Corporation, Tualatin, OR (US)

( * ) Notice: Subject to any disclaimer, the term of this patent is extended or adjusted under 35 U.S.C. 154(b) by 42 days.

(21) Appl. No.: 11/594,373

(22) Filed: Nov. 7, 2006

(65) Prior Publication Data

US 2007/0101579 A1 May 10, 2007

Related U.S. Application Data

(60) Provisional application No. 60/734,551, filed on Nov. 7, 2005.

(51) Int. Cl.
*B26B 3/06* (2006.01)

(52) U.S. Cl. ..... 30/153; 30/155; 30/161

(58) Field of Classification Search ..... 30/36, 30/57, 62, 66, 153, 155, 157–158, 160–161, 30/300, 331, 333, 337
See application file for complete search history.

(56) References Cited

U.S. PATENT DOCUMENTS

| | | | | |
|---|---|---|---|---|
| 2,924,879 | A * | 2/1960 | Kraus, Jr. | 30/151 |
| 3,009,245 | A * | 11/1961 | Senkewitz | 30/155 |
| 4,354,313 | A * | 10/1982 | Naifeh | 30/161 |
| 4,670,984 | A | 6/1987 | Rickard | |
| 4,730,394 | A * | 3/1988 | Sonner, Jr. | 30/161 |
| 4,750,267 | A * | 6/1988 | Boyd | 30/161 |
| 4,823,463 | A * | 4/1989 | Lemaire | 30/162 |
| 4,974,323 | A * | 12/1990 | Cassady | 30/155 |
| 5,025,557 | A * | 6/1991 | Perreault | 30/151 |
| 5,029,354 | A * | 7/1991 | Boyd et al. | 7/118 |
| 5,933,893 | A * | 8/1999 | Padden | 7/158 |
| 6,154,965 | A | 12/2000 | Sakai | |
| 6,158,127 | A * | 12/2000 | Taylor | 30/158 |
| 6,256,888 | B1 * | 7/2001 | Shuen | 30/161 |
| 6,363,615 | B1 | 4/2002 | Moser | |
| 6,378,214 | B1 | 4/2002 | Onion | |
| 6,523,265 | B2 * | 2/2003 | Eickhorn | 30/161 |
| 7,181,849 | B2 * | 2/2007 | Menter | 30/159 |
| 7,513,045 | B2 * | 4/2009 | Kain | 30/158 |

* cited by examiner

*Primary Examiner*—Jason Daniel Prone
*Assistant Examiner*—Joseph DeFrank
(74) *Attorney, Agent, or Firm*—Klarquist Sparkman, LLP

(57) ABSTRACT

In one aspect, a folding knife has a locking mechanism coupled to the blade such that pivoting the blade from the closed position to the open position, and vice versa, causes corresponding rotation of the locking mechanism about the pivot axis of the blade. The locking mechanism is operable to selectively lock the blade in the open position and optionally to selectively lock the blade in the closed position.

23 Claims, 6 Drawing Sheets

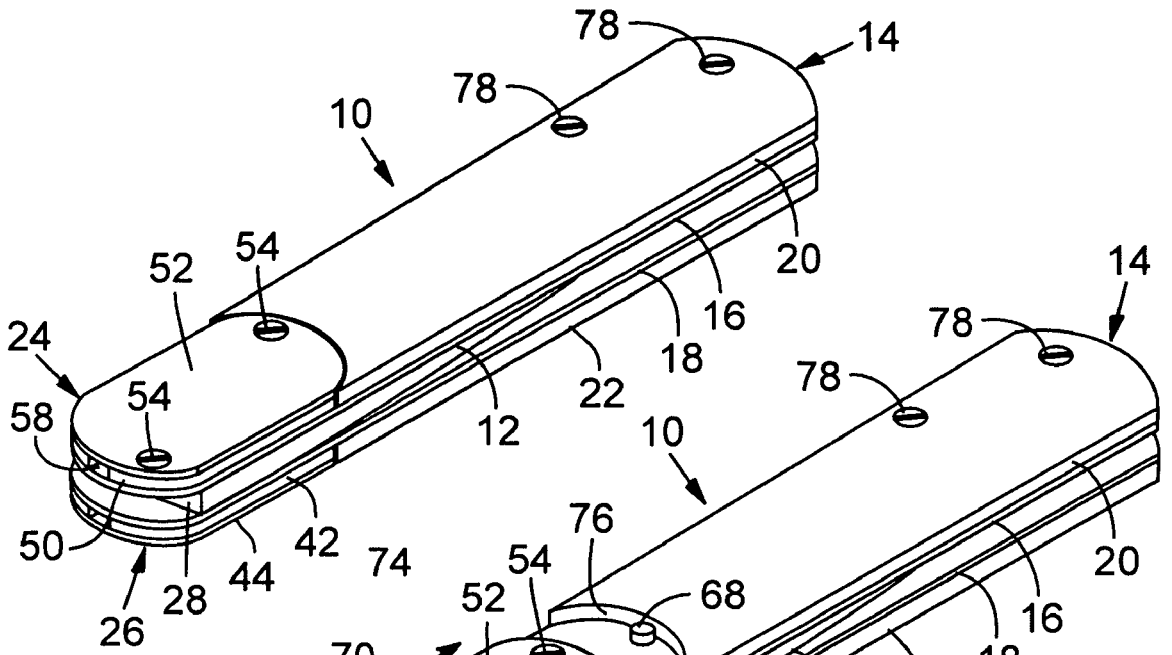
FIG. 2
FIG. 3
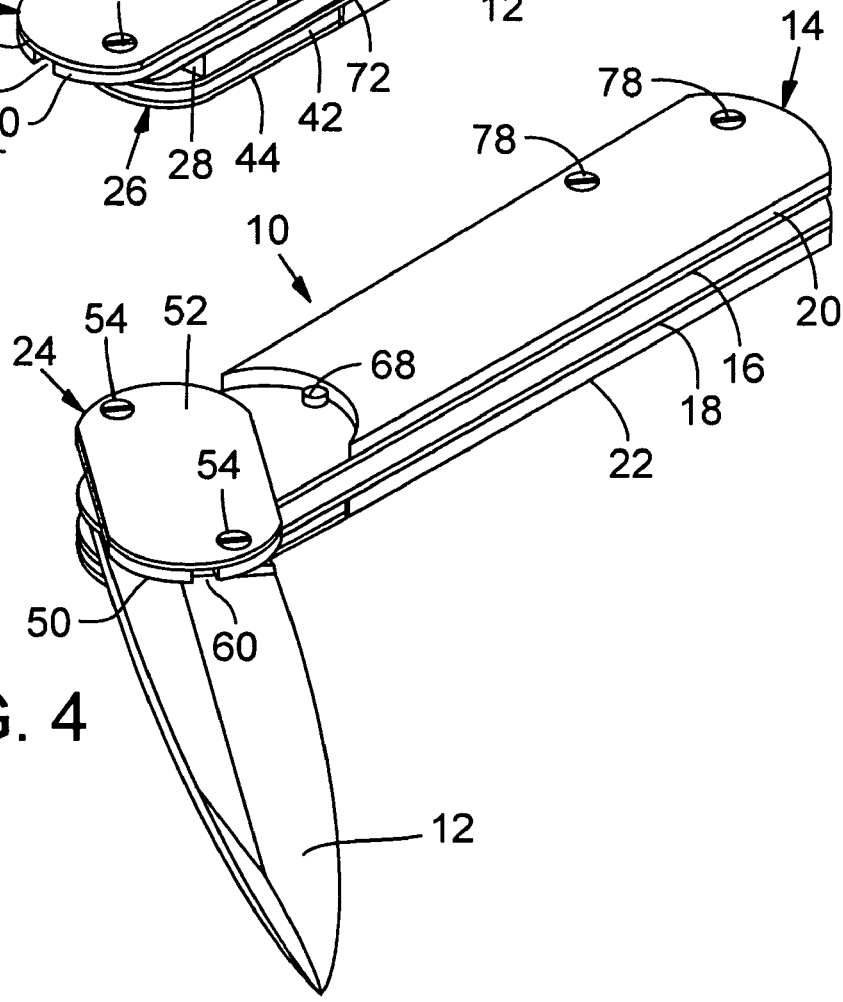
FIG. 4

FOLDING KNIFE

CROSS-REFERENCE TO RELATED APPLICATION

The present application claims the benefit of U.S. Provisional Application No. 60/734,551, filed Nov. 7, 2005, which is incorporated herein by reference.

FIELD

The present invention relates to a folding knife, and in particular, a folding knife having a locking mechanism that rotates with the blade.

BACKGROUND

One form of conventional sport or work knives comprises a handle and one or more folding blades. The blades in such knives are closed simply by pressing on the back of the blade and rotating the blade to a closed position in the knife handle. Such knives are known for their ability to close when being used if a pressure is inadvertently applied to the back of the blade.

To protect against inadvertent closure, various types of locks were developed for locking a blade in an open position. A common type of locking element known as a liner lock extends longitudinally through the handle and is spring biased to snap into position adjacent to the hinged end (tang) of the blade when the blade is opened. A projecting portion of the locking element or other release mechanism is manipulated to manually move the locking element laterally away from the blade swing path so that the blade can be closed.

Further, various mechanisms have been developed to facilitate opening and/or closing of the blade of a conventional folding knife. Typically, the blade is provided with a thumb stud that can be manipulated by the user to open and close the blade.

Despite the long and continued development of folding knives, it would be desirable to provide a folding knife with a novel blade-locking mechanism and/or novel blade-opening mechanism.

SUMMARY

In one aspect, the present disclosure concerns a folding knife having a locking mechanism coupled to the blade such that pivoting the blade from the closed position to the open position, and vice versa, causes corresponding rotation of the locking mechanism about the pivot axis of the blade. The locking mechanism is operable to selectively lock the blade in the open position and optionally to selectively lock the blade in the closed position. In particular embodiments, the locking mechanism is a bolster of the knife handle. The locking mechanism can be slid longitudinally of the blade between a first, locked position to lock the blade in the open or closed positions and a second, unlocked position to permit pivoting of the blade. When the locking mechanism in this embodiment is in the locked position, it abuts an adjacent side panel of the knife so as to resemble a conventional bolster.

The handle can be provided with a locking element, such as in the form of a locking pin, that is positioned to engage a corresponding surface of the locking mechanism when it is slid to the locked position, thereby preventing pivoting of the blade. In certain embodiments, first and second notches for engaging the locking pin can be formed on opposite sides of the locking mechanism. When the blade is in the closed position, the locking mechanism can be slid to the locked position to engage the locking pin in the first notch, thereby locking the blade in the closed position. Opening the blade causes the locking mechanism to rotate 180 degrees about the pivot axis. In this position, the locking mechanism can be slid to the locked position to engage the locking pin in the second notch, thereby locking the blade in the open position.

The locking mechanism in exemplary embodiments can be coupled to the blade by a pivot element disposed in the handle and extending through an opening in a tang portion of the blade and into an opening of the locking mechanism. The pivot element can be formed with a non-circular cross-sectional profile, such as an oblong profile, where it extends through the tang portion and into the locking mechanism. The opening in the tang portion is shaped to correspond to the shape of the pivot element so that pivoting movement of the blade causes corresponding rotation of the pivot element. The pivot element also engages the sides of the slot in the locking mechanism so that pivoting movement of the blade causes rotation of the pivot element and the locking mechanism about the blade pivot axis. Conversely, rotation of the locking mechanism is effective to cause corresponding pivoting movement of the blade. In this manner, the locking mechanism can be used as an opening and closing mechanism for the blade. The slot in the locking mechanism also is dimensioned to allow the locking mechanism to be slid relative to the pivot element in a direction perpendicular to the pivot axis between the locked and unlocked positions.

In one representative embodiment, a folding knife comprises a handle portion having a locking pin and a blade having a tang portion pivotably coupled to the handle portion. The blade is pivotable relative to the handle portion between a closed, or folded, position and an open, or extended, position. The knife can also include a locking mechanism coupled to the tang portion of the blade such that the locking mechanism is caused to pivot with the blade when the blade is opened or closed. The locking mechanism is slidable relative to the handle portion and the blade between a rearward position engaging the locking pin to prevent pivoting of the blade from the open position and a forward position spaced from the locking pin to allow for pivoting movement of the blade.

In another representative embodiment, a folding knife comprises a handle portion and a blade having a tang portion pivotably coupled to the handle portion. The blade is pivotable relative to the handle portion between a closed, or folded, position and an open, or extended, position. A locking mechanism can be coupled to the tang portion of the blade such that the locking mechanism is caused to pivot with the blade when the blade is opened or closed. The knife can also include a pivot element defining a pivot axis for the blade and the locking mechanism. The pivot element can be disposed in the handle portion and can extend through the tang portion and into an opening in the locking mechanism. The locking mechanism is slidable relative to the pivot element between a first, locked position to prevent pivoting of the blade from the open position and a second, unlocked position to allow for pivoting movement of the blade.

In another representative embodiment, a folding knife comprises a handle portion and a blade having a tang portion coupled to the handle portion. The blade is pivotable relative to the handle portion between a closed, or folded, position and an open, or extended, position. The knife can further include a blade locking member that is pivotable 180 degrees with the blade when the blade is pivoted between from the open position to the closed position and vice versa. A pivot element, defining a pivot axis extending through the locking member, is disposed in the handle portion and extends through the tang portion. When the blade is in the open position, the locking member can be moved longitudinally of the blade between a first, locked position to prevent pivoting of the blade and a second, unlocked position to allow the blade to be pivoted to the closed position.

In still another representative embodiment, a folding knife comprises a handle portion having a blade locking mechanism and a blade having a tang portion coupled to the handle portion. The blade is pivotable relative to the handle portion between a closed, or folded, position and an open, or extended, position. A pivot element defines a pivot axis for the blade and can have a portion extending through a non-circular opening in the tang portion, said portion of the pivot element having a non-circular cross-sectional profile which causes the pivot element to rotate about the pivot axis upon pivoting movement of the blade. The locking mechanism can be connected to the pivot element and can be operable to rotate about the pivot axis to cause corresponding rotation of the pivot element and pivoting movement of the blade about the pivot axis. The locking mechanism can be moved relative to the pivot element in a direction perpendicular to the pivot axis between a first, locked position to prevent pivoting of the blade from the open position and a second, unlocked position to allow the blade to be pivoted to the closed position.

In another representative embodiment, a folding knife comprises a handle portion and a blade having a tang portion pivotably coupled to the handle portion. The blade is pivotable relative to the handle portion between a closed, or folded, position and an open, or extended, position. A pivot element extends through the tang portion of the blade and defines a pivot axis. The pivot element is adapted to rotate about the pivot axis upon pivoting movement of the blade. The knife can also include a blade-opening mechanism connected to the pivot element and being operable to rotate about the pivot axis to cause corresponding pivoting movement of the blade. The blade-opening mechanism is moveable relative to the pivot element and the blade in a direction perpendicular to the pivot axis to a position off-center from the pivot element to provide additional leverage for opening the blade.

The foregoing and other features of the invention will become more apparent from the following detailed description of several embodiments, which proceeds with reference to the accompanying figures.

BRIEF DESCRIPTION OF THE DRAWINGS

FIG. 2 is a perspective view of the knife shown with the blade in the closed position.

FIG. 3 is a perspective view of the knife showing the locking mechanism in an unlocked position to allow the blade to be pivoted to the open position.

FIG. 4 is a perspective view of the knife showing the blade being pivoted to the open position.

DETAILED DESCRIPTION

As used herein, the singular forms "a," "an," and "the" refer to one or more than one, unless the context clearly dictates otherwise.

As used herein, the term "includes" means "comprises." For example, a device that includes or comprises A and B contains A and B but may optionally contain C or other components other than A and B. A device that includes or comprises A or B may contain A or B or A and B, and optionally one or more other components such as C.

Figures 5, 6:
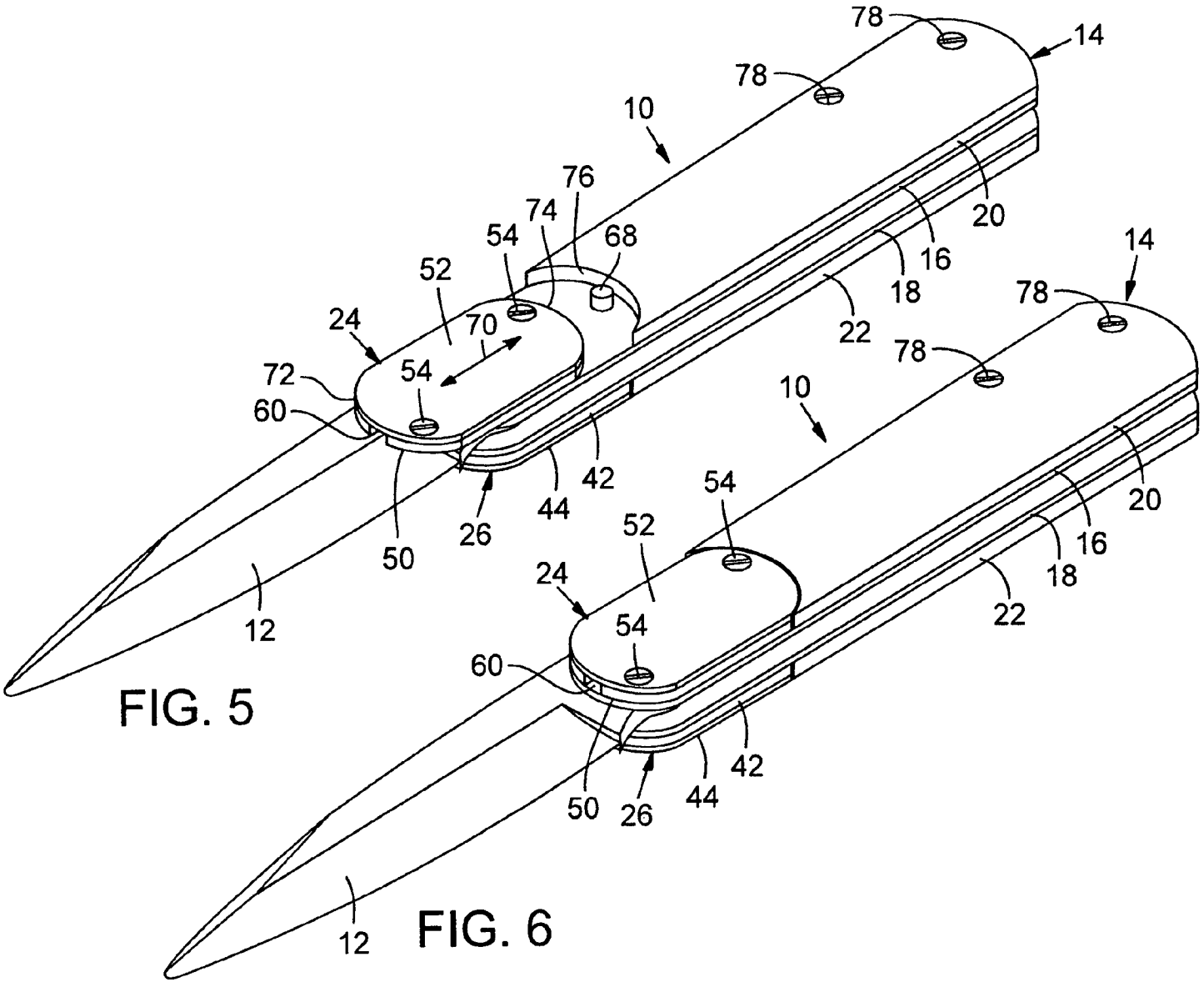
FIG. 5 is a perspective view of the knife showing the blade in the fully extended, open position and the locking mechanism in an unlocked position.
FIG. 6 is a perspective view of the knife showing the blade in the fully extended, open position and the locking mechanism in a locked position to retain the blade in the open position.
Figure 9:
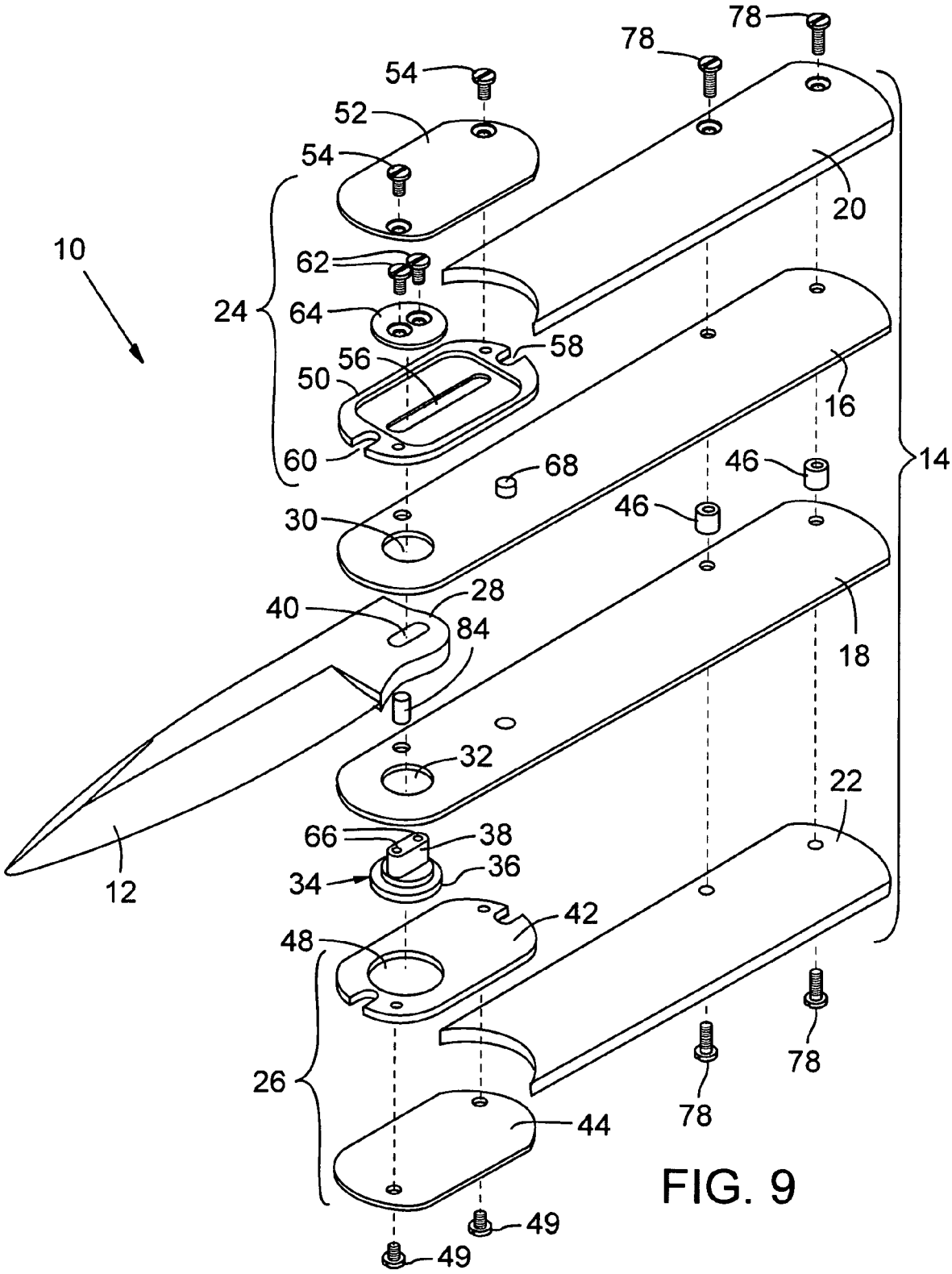
FIG. 9 is a perspective, exploded view of the knife.

Referring to the drawings, a folding knife 10, according to one embodiment, comprises a blade 12 pivotably coupled to a handle 14 (also referred to as handle portion). The blade 12 is pivotable between a folded, or closed, position inside the handle 14 (FIG. 2) and a fully extended, open position (FIG. 5). As best shown in FIG. 9, the handle 14 in the illustrated embodiment comprises first and second inner liners 16 and 18, respectively, and first and second side panels 20 and 22, respectively, disposed outside of the liners 16, 18. The knife 10 includes a locking mechanism 24 that is mounted for rotational movement with the blade and is operable to lock the blade 12 in the open position and optionally lock the blade 12 in the closed position, as described in detail below. The locking mechanism 24 in the illustrated embodiment is in the form of a first bolster of the knife. The knife 10 can also include a second bolster 26 positioned on the opposite side of the handle.

The blade 12 has a tang portion 28 disposed between the forward end portions of the liners 16, 18, which can be separated by spacers 46. The liners 16, 18 and the side panels 20, 22 can be held together by screws 78 extending through corresponding openings in the side panels and tightened into the spacers. In alternative embodiments, the handle 14 can have various other configurations. For example, each liner 16, 18 and corresponding side panel 20, 22 can be formed as a unitary member rather than separate components held together with fasteners.

Figure 1A:
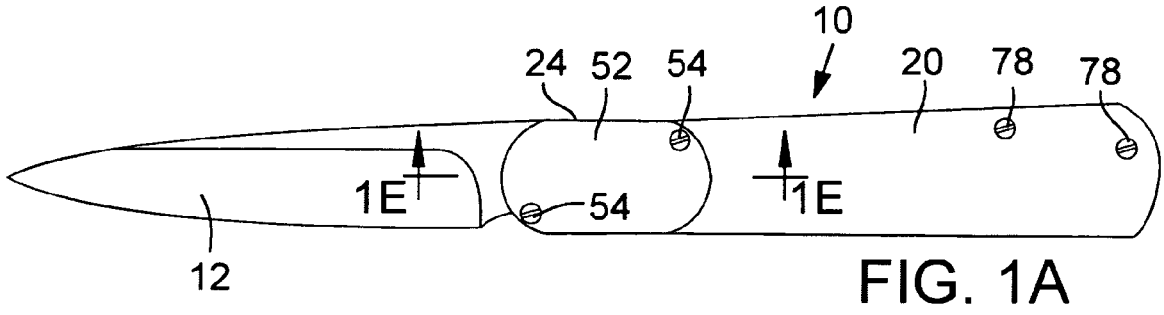
FIG. 1A is a side view of a folding knife shown with the blade in the open position, according to one embodiment.
Figure 1B:
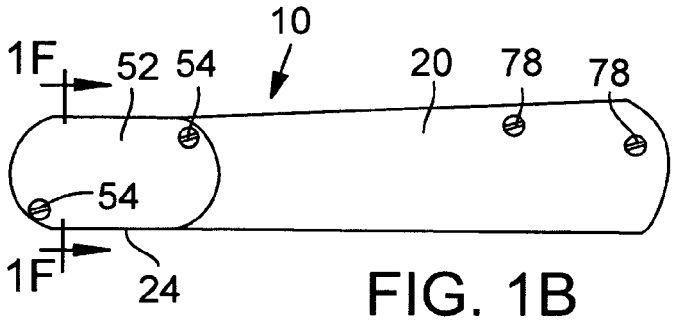
FIG. 1B is a side view of the knife shown with the blade in the folded, or closed, position.
Figure 1C:
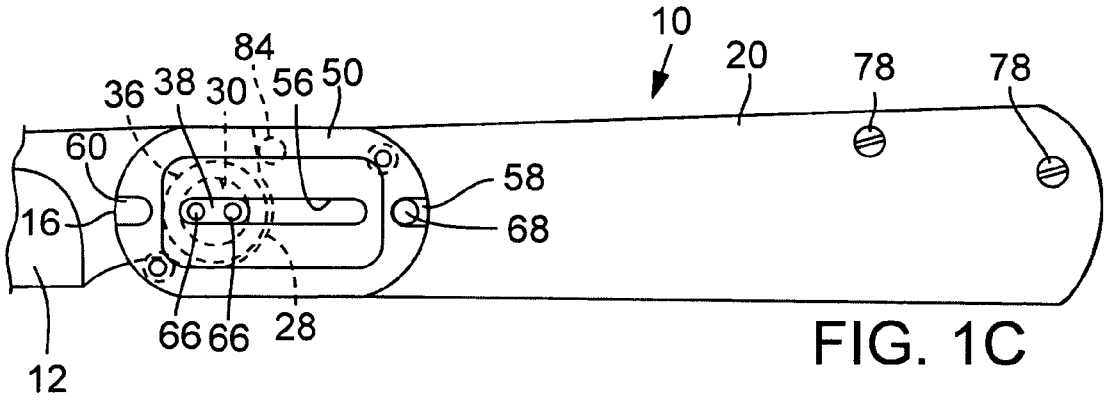
FIG. 1C is a fragmentary side view of the knife shown with the blade in the open position and with the cover plate of the locking mechanism removed for clarity.
Figure 1D:
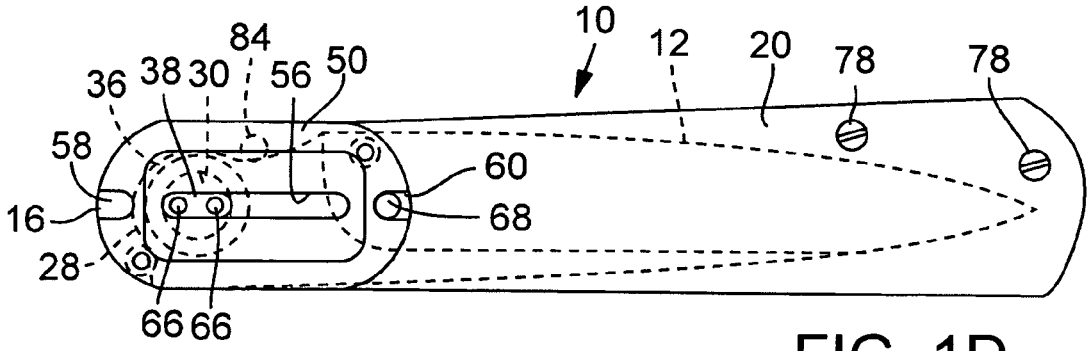
FIG. 1D is a side view of the knife similar to FIG. 1C but showing the blade in the closed position.

A stop pin 84 or equivalent structure can be positioned between the liners 16, 18 to limit pivoting of the blade past the open and closed positions. As shown in FIG. 1C, the stop pin 84 is positioned to contact the back edge of the tang portion 28 to limit pivoting movement of the blade 12 past the open position. When the blade is closed, the stop pin 84 may contact a lower edge of the tang portion to prevent pivoting of the blade past the closed position (FIG. 1D).

The liners 16, 18 can be formed with respective openings 30 and 32 for receiving a pivot element 34 for supporting the blade 12 and the locking mechanism. The pivot element 34 in the illustrated example defines a pivot axis extending through the tang portion 28 and the locking mechanism 24. The pivot element 34 in particular embodiments includes a circular base 36 and an extension portion 38 having a non-circular cross-sectional profile that extends through a complimentary shaped opening 40 in the tang portion 28 and into an elongated slot, or opening, 56 in the locking mechanism 24. In the illustrated embodiment, for example, the extension portion 38 of the pivot element has a relatively narrow, oblong cross-sectional profile with flat sides and the opening 40 in the tang portion 28 has a similar oblong shape. The slot 56 has straight sides defining a relatively narrow width that is slightly greater than the width of the extension portion 38. By virtue of the shape of the extension portion 38, the opening 40, and the slot 56, pivoting movement of the blade 12 causes corresponding rotation of the pivot element 34 and the locking mechanism 24 about the pivot axis. Thus, in the illustrated example, pivoting the blade 12 from the closed position to the open position, and vice versa, causes the locking mechanism 24 to rotate 180 degrees about the pivot axis. In alternative embodiments, various other shapes can be utilized for the extension portion 38, the opening 40, and the slot 56 to effect simultaneous movement of the blade, pivot element and the locking mechanism. For example, the extension portion 38 and the opening 40 can be a square, rectangle, triangle, ellipse, or various combinations thereof.

Figure 1E:
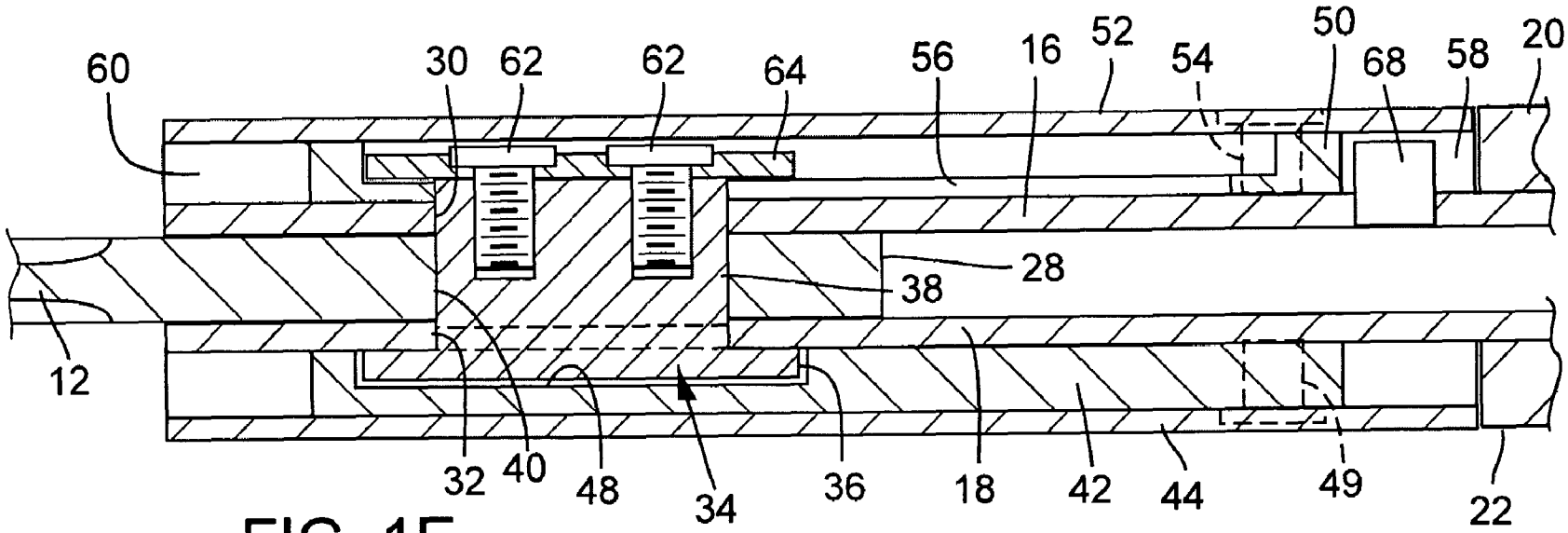
FIG. 1E is a cross-sectional view taken along line 1E-1E of FIG. 1A.
Figure 1F:
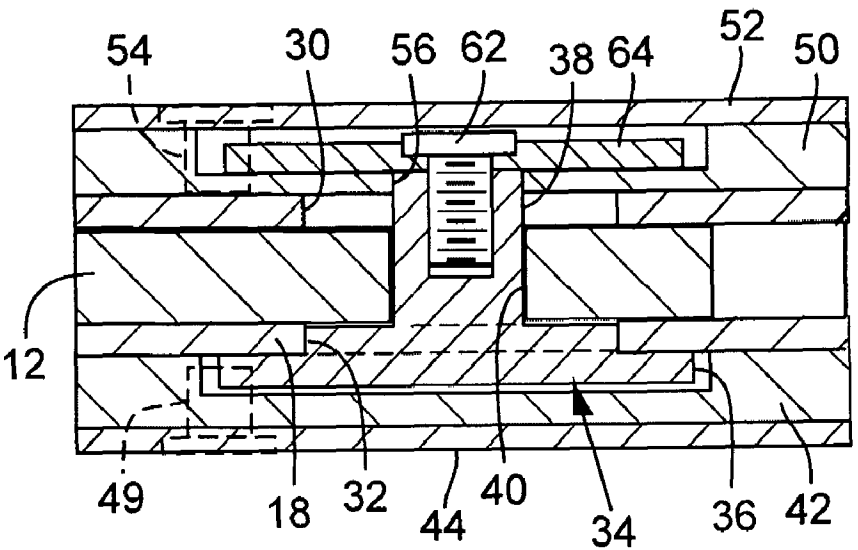
FIG. 1F is a cross-sectional view taken along line 1F-1F of FIG. 1B.

The second bolster 26 can include an inner plate 42 and an outer plate, or panel, 44, which can be secured to the plate 42 by screws 49. The plate 42 can be formed with a recess, or bore, 48 that receives the base 36 of the pivot element 34. As best shown in FIG. 1E, when the knife is assembled, the base 36 is disposed in the bore 48 and the extension portion 38 extends through openings 30, 32 in the liners 16, 18, the opening 40 in the blade, and into the slot 56 in the locking mechanism 24.

The locking mechanism 24 is configured to be slidable relative to the pivot element 34 in a direction perpendicular to the pivot axis to lock and unlock the blade when the blade is in the open position and optionally when the blade is in the closed position. In the illustrated example, the locking mechanism is configured to slide longitudinally of the blade (lengthwise of the blade) to lock and unlock the blade (as indicated by double-headed arrow 70 in FIGS. 3 and 5). In certain embodiments, the locking mechanism 24 comprises a slidable inner plate 50 and an outer plate, or panel, 52, which can be secured to the plate 50 by screws 54. The slot 56 (which receives the extension portion 38 of the pivot element 34) is formed in the inner plate 50, which can also be formed with first and second notches 58 and 60, respectively, formed at opposite ends of the plate. The locking mechanism 24 can be secured to the pivot element 34 by screws 62 that extend through corresponding openings in a washer 64 and slot 56, and are tightened into corresponding threaded openings 66 (FIGS. 1E and 9) in the extension portion 38 of the pivot element 34. The slot 56 is sized and shaped such that rotation of the pivot element 34 causes the locking mechanism 24 to rotate with the pivot element and the blade and allow the locking mechanism 24 to slide lengthwise of the blade relative to the pivot element to effect locking of the blade in the open or closed positions, as further described below.

Figures 7, 8:
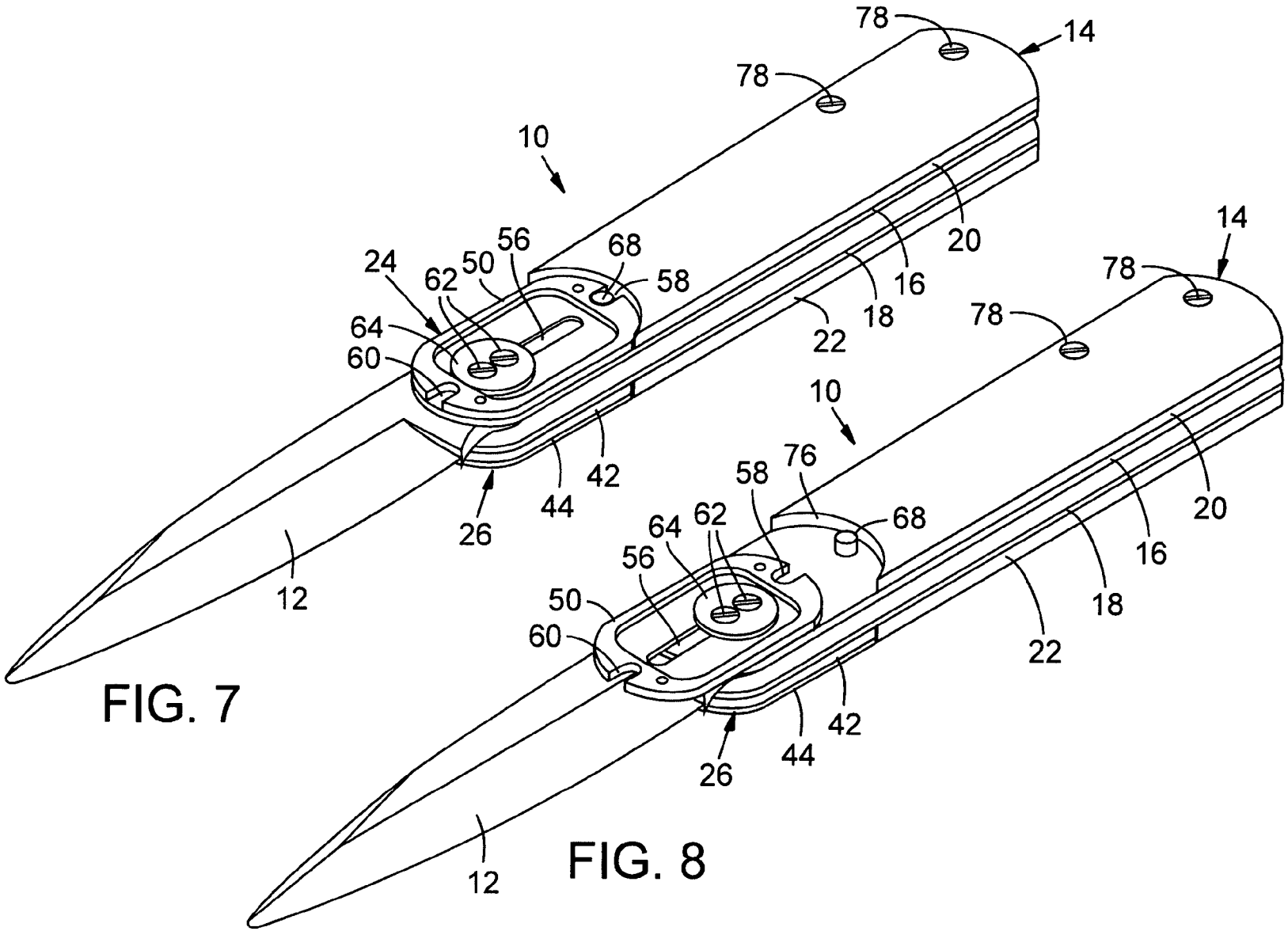
FIG. 7 is a perspective view of the knife similar to that shown in FIG. 6 but with the cover plate of the locking mechanism removed for illustrating the inside of the locking mechanism.
FIG. 8 is a perspective view of the knife similar to that shown in FIG. 7 but showing the locking mechanism in the unlocked position to allow the blade to be closed.

The handle 14 is provided with a locking element, for example in the form of a locking pin 68 extending transversely from the first liner 16, that is positioned to engage the notches 58, 60 in the slidable plate 50 of the locking mechanism. The locking mechanism 24 is operable to slide relative to the handle portion 14 and the blade 12 between a forward, unlocked position and a rearward, locked position when the blade 12 is in the open position and the closed position. As shown in FIG. 7, to lock the blade 12 in the open position, the locking mechanism 24 is slid to the rearmost, locked position with the locking pin 68 engaging the notch 58, thereby resisting pivoting of the blade to the closed position. To unlock the blade, the locking mechanism 24 is slid to the forward-most position toward the tip of the blade to remove the plate 50 from engagement with the locking pin 68 (FIG. 8). At this point, the blade 12 is free to pivot to the closed position. Once in the closed position, the blade 12 can be locked in place by sliding the locking mechanism rearwardly to cause the locking pin 68 to engage the notch 60 in the plate 50 (FIG. 1D).

As best shown in FIG. 3, the locking mechanism 24 in the illustrated configuration is formed with arcuate end portions 72, 74 that correspond to a similarly shaped end surface 76 of the first side panel 20. The end portions 72, 74 desirably are curved so that the locking pin 68 does not interfere with the rotation of the locking mechanism 24 when the blade is opened or closed. In addition, as depicted in FIGS. 2 and 6, when the locking mechanism 24 is in the locked position, the locking mechanism abuts the side panel 20 and resembles a conventional bolster. In alternative embodiments, the locking mechanism 24 can have various other shapes or configurations and still effect locking of the blade in the manner described above. For example, the locking mechanism can be a disc or wheel that is connected to the pivot element 34 as previously described.

Another unique feature of the locking mechanism 24 in the illustrated embodiment is that it can be used to open or close the blade. For example, to open the blade from the closed position (FIG. 2), the locking mechanism is first slid to the unlocked position (FIG. 3), such as by applying pressure to the locking mechanism with the thumb. The locking mechanism 24 can then be rotated by applying thumb pressure in the direction of arrow 80 (FIG. 3) to cause the blade 12 to pivot outwardly from the handle to the open position (FIG. 5). The locking mechanism 24 can then be slid rearwardly to the locked position with the thumb to engage the locking pin 68 (FIG. 6). The blade 12 can be pivoted closed by performing the foregoing steps in the reverse sequence. By virtue of its elongated shape in the illustrated embodiment, the locking mechanism 24 can function as a lever for opening and closing the blade. Further, when slid to the unlocked position, the locking mechanism 24 is positioned off-center from the pivot element 34 (the pivot element 34 is positioned closer to one end of the locking mechanism 24, as best shown in FIG. 8), which creates additional leverage to facilitate opening and closing of the blade.

In an alternative embodiment, the locking mechanism 24 can have a construction similar to that shown in the figures, but is not formed with a notch 60 to engage the locking pin 68 when the blade 12 is in the closed position. Thus, in this alternative embodiment, the locking mechanism 24 functions only to lock the blade when it is in the open position. The screws 62 can be tightened to provide sufficient frictional force to prevent the blade 12 from opening under its own weight, such as when holding or carrying the knife.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. I therefore claim as my invention all that comes within the scope and spirit of these claims.

I claim:

1. A folding knife comprising:

a handle portion having a locking pin;

a blade having a tang portion pivotably coupled to the handle portion, the blade being pivotable relative to the handle portion between a closed, or folded, position and an open, or extended, position;

a locking mechanism coupled to the tang portion of the blade such that the locking mechanism is caused to pivot 180 degrees with the blade when the blade is pivoted from the closed position to the open position and vice versa, the locking mechanism having an elongated slot and first and second notches formed on opposite sides thereof; and a pivot element disposed in the handle portion and extending through a non-circular opening in the tang portion and into the slot in the locking mechanism, the pivot element defining a pivot axis extending through the tang portion of the blade and the locking mechanism, the pivot element having a non-circular cross-sectional profile where it extends through the opening in the tang portion and into the slot in the locking member such that pivoting movement of the blade causes corresponding rotation of the pivot element and the locking mechanism about the pivot axis;

the locking mechanism being slidable relative to the pivot element lengthwise of the blade between first and second positions such that when the blade is in the open position, the locking mechanism can be moved to the first position to cause the first notch to engage the locking pin and prevent pivoting of the blade and to the second position to move the first notch away from the locking pin to permit pivoting of the blade, and when the blade is in the closed position, the locking mechanism can be moved to the first position to cause the second notch to engage the locking pin and prevent pivoting of the blade and to the second position to move the second notch away from the locking pin to permit pivoting of the blade.

2. A folding knife comprising:

a handle portion;

a blade having a tang portion pivotably coupled to the handle portion, the blade being pivotable relative to the handle portion between a closed, or folded, position and an open, or extended, position;

a pivot element extending through the tang portion of the blade and defining a pivot axis, the pivot element being adapted to rotate about the pivot axis upon pivoting movement of the blade, the pivot element comprising an extension portion having a non-circular cross-section in a plane perpendicular to the pivot axis; and a blade-opening mechanism connected to the pivot element and having a non-circular opening that receives the extension portion of the pivot element, the opening being sized and shaped to prevent rotation of the blade-opening mechanism relative to the pivot element, the blade-opening mechanism being operable to rotate about the pivot axis to cause corresponding pivoting movement of the blade, the blade-opening mechanism being moveable relative to the pivot element and the blade in a direction perpendicular to the pivot axis to a position off-center from the pivot element to provide additional leverage for opening the blade.

3. The folding knife of claim 2, wherein the handle portion comprises a locking element and the blade-opening mechanism is moveable relative to the pivot element and the blade in said direction to a locked position engaging the locking element when the blade is in the open position to prevent movement of the blade.

4. A folding knife comprising:

a handle portion having a blade locking mechanism;

a blade having a tang portion coupled to the handle portion, the blade being pivotable relative to the handle portion between a closed, or folded, position and an open, or extended, position; and a pivot element defining a pivot axis for the blade and having a portion extending through a non-circular opening in the tang portion, said portion of the pivot element having a non-circular cross-sectional profile which causes the pivot element to rotate about the pivot axis upon pivoting movement of the blade;

the locking mechanism being connected to the pivot element and operable to rotate about the pivot axis to cause corresponding rotation of the pivot element and pivoting movement of the blade about the pivot axis;

the locking mechanism being moveable relative to the pivot element in a direction perpendicular to the pivot axis between a first, locked position to prevent pivoting of the blade from the open position and a second, unlocked position to allow the blade to be pivoted to the closed position.

5. The folding knife of claim 4, wherein the locking mechanism is a bolster of the handle portion.

6. A folding knife comprising:

a handle portion;

a blade having a tang portion coupled to the handle portion, the blade being pivotable relative to the handle portion between a closed, or folded, position and an open, or extended, position, the blade having a cutting edge and a non-cutting edge opposite the cutting edge, the cutting edge and the non-cutting edge defining a plane within which the blade pivots from the closed position to the open position;

a blade locking member that is pivotable 180 degrees with the blade when the blade is pivoted between from the open position to the closed position and vice versa; and a pivot element disposed in the handle portion and extending through the tang portion and defining a pivot axis for the blade and the locking member, the pivot axis extending through the locking member;

wherein when the blade is in the open position, the locking member is movable longitudinally of the blade between a first, locked position to prevent pivoting of the blade and a second, unlocked position to allow the blade to be pivoted to the closed position.

7. The folding knife of claim 6, wherein the pivot element extends into an elongated slot in the locking member, and the locking member is slidable relative to the pivot element between the locked and unlocked positions.

8. The folding knife of claim 7, wherein the pivot element has a non-circular cross-sectional profile where it extends through the tang portion and into the slot in the locking member such that pivoting movement of the blade causes corresponding rotation of the pivot element and the locking member about the pivot axis.

9. A folding knife comprising:

a handle portion;

a blade having a tang portion pivotably coupled to the handle portion, the blade being pivotable relative to the handle portion between a closed, or folded, position and an open, or extended, position, the blade having a cutting edge and a non-cutting edge opposite the cutting edge, the cutting edge and the non-cutting edge defining a plane within which the blade pivots from the closed position to the open position;

a locking mechanism coupled to the tang portion of the blade such that the locking mechanism is caused to pivot with the blade when the blade is opened or closed; and a pivot element disposed in the handle portion and extending through the tang portion and into an opening in the locking mechanism, the pivot element defining a pivot axis for the blade and the locking mechanism;

the locking mechanism being slidable relative to the pivot element between a first, locked position to prevent pivoting of the blade from the open position and a second, unlocked position to allow for pivoting movement of the blade.

10. The folding knife of claim 9, wherein the handle portion comprises a locking element, and the locking mechanism is configured to engage the locking element when the blade is in the open position and the locking mechanism is slid to the locked position to prevent pivoting of the blade, and when the locking mechanism is moved to the unlocked position, the locking mechanism disengages from the locking element to allow for pivoting movement of the blade.

11. The folding knife of claim 10, wherein:

the locking mechanism comprises first and second locking surfaces; and when the blade is in the closed position, the locking mechanism can be moved to the locked position to cause the first locking surface to engage the locking element, and when the blade is pivoted 180 degrees from the closed position to the open position, the locking mechanism can be moved to the locked position to cause the second locking surface to engage the locking element.

12. The folding knife of claim 11, wherein the locking element comprises a locking pin and the first and second locking surfaces comprise first and second notches, respectively, on opposite sides of the locking mechanism.

13. The folding knife of claim 9, wherein the pivot element has a non-circular portion extending through a complimentary shaped opening in the tang portion, the non-circular portion and the opening in the tang portion being shaped such that pivoting of the blade causes corresponding rotation of the pivot element.

14. A folding knife comprising:

a handle portion having a locking pin;

a blade having a tang portion pivotably coupled to the handle portion, the blade being pivotable relative to the handle portion between a closed, or folded, position and an open, or extended, position; and a locking mechanism coupled to the tang portion of the blade such that the locking mechanism is caused to pivot with the blade when the blade is opened or closed, the locking mechanism also being slidable relative to the handle portion and the blade between a rearward position engaging the locking pin to prevent pivoting of the blade from the open position and a forward position spaced from the locking pin to allow for pivoting movement of the blade.

15. The knife of claim 14, wherein the locking mechanism comprises a bolster of the handle.

16. The knife of claim 14, wherein the locking mechanism is configured to engage the locking pin and prevent pivoting movement of the blade when the blade is in the open and closed positions.

17. The knife of claim 16, wherein the locking mechanism is formed with first and second notches at opposite ends thereof, such that when the blade is in the closed position and the locking mechanism is slid to the rearward position, the locking pin engages the first notch to prevent pivoting of the blade, and when the blade is in the open position and the locking mechanism is slid to the rearward position, the locking pin engages the second notch to prevent pivoting of the blade.

18. The knife of claim 14, further comprising a pivot disposed in the handle portion and extending through the tang portion of the blade, the pivot defining the pivot axis about which the blade pivots, the pivot being rotatable about the pivot axis when the blade is pivoted to the open or closed positions.

19. The knife of claim 18, wherein the pivot extends into an opening of the locking mechanism, the pivot being adapted to produce rotation of the locking mechanism through 180 degrees when the blade is pivoted from the open position to the closed position or from the closed position to the open position.

20. The knife of claim 19, wherein the locking mechanism is slidable relative to the pivot lengthwise of the blade between the forward position and the rearward position.

21. The knife of claim 18, wherein the pivot comprises an oblong extension portion that extends through a non-circular, oblong opening in the tang portion of the blade.

22. The knife of claim 14, further comprising a pivot disposed in the handle portion and extending through the tang portion of the blade, the pivot defining a pivot axis extending though the locking mechanism, the blade and the locking mechanism being configured to pivot together about the pivot axis when the blade is pivoted from the open position to the closed position or from the closed position to the open position.

23. The knife of claim 22, wherein the pivot extends into an elongated slot in the locking mechanism, the locking mechanism being slidable relative to the pivot between the forward position and the rearward position.

* * * * *